United States Patent [19]

Walker

[11] Patent Number: 4,850,641

[45] Date of Patent: Jul. 25, 1989

[54] COMBINATION CARRYING POUCH AND SEAT FOR WALKERS

[76] Inventor: Eugene R. Walker, R.D. #1, Box 497, Central City, Pa. 15926

[21] Appl. No.: 229,427

[22] Filed: Aug. 8, 1988

[51] Int. Cl.[4] ..... A47D 13/04

[52] U.S. Cl. ..... 297/6; 297/129

[58] Field of Search ..... 297/6, 5, 129, 118

[56] References Cited

U.S. PATENT DOCUMENTS

| | | | |
|---|---|---|---|
| 2,044,717 | 6/1936 | McElmoyl | 297/129 |
| 2,224,246 | 12/1940 | Ames | 297/6 |
| 2,305,249 | 12/1942 | Frost | 297/6 |
| 3,354,893 | 11/1967 | Schmerl | 297/6 |
| 3,633,906 | 1/1972 | Fowler | 297/5 |
| 3,825,298 | 7/1974 | Chipman | 297/129 |
| 4,184,618 | 1/1980 | Jones | 297/5 |
| 4,345,790 | 8/1982 | Coe | 297/6 |
| 4,415,198 | 11/1983 | Brearley | 297/6 |
| 4,621,804 | 11/1986 | Mueller | 297/6 |

*Primary Examiner*—Francis K. Zugel

*Attorney, Agent, or Firm*—H. Jay Spiegel

[57] ABSTRACT

The present invention relates to a combination carrying pouch and seat for walkers. The inventive device includes a substantially rectangular piece of material having one end which may be securely fastened to front portions of the walker and having another end which may be releasably attached to either rear portions of the walker or front portions thereof. When the another end of the walker is attached to rear portions of the walker, the material is in an open configuration and may be used as a seat. When the another end is attached to front portions of the walker, the material is in a folded configuration rendering it usable as a carrying pouch.

8 Claims, 1 Drawing Sheet

FIG. 1
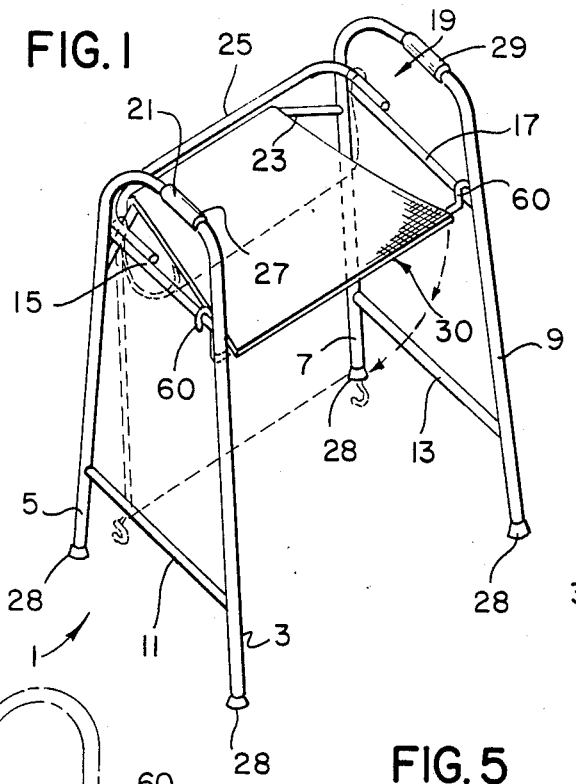
FIG. 2
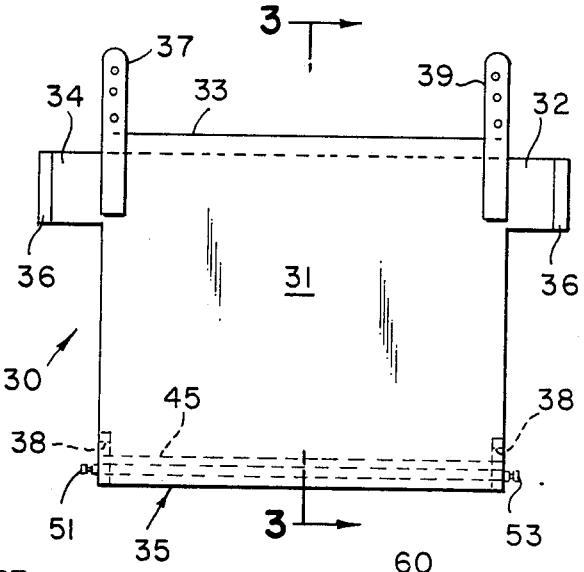
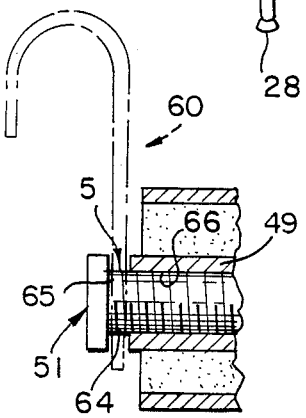
FIG. 4
FIG. 5
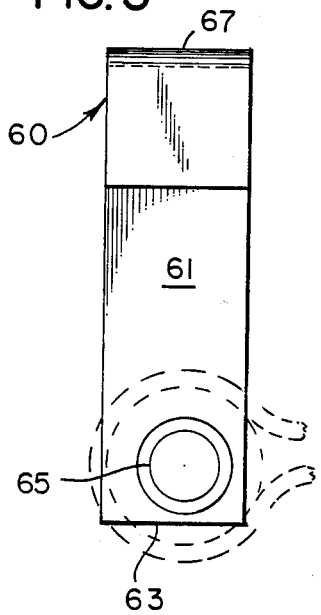
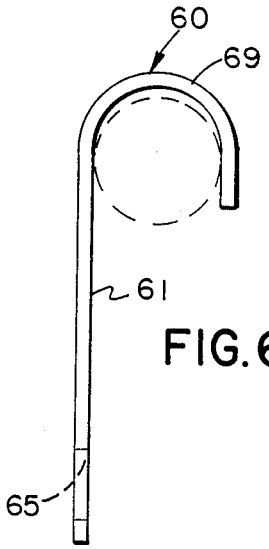
FIG. 6
FIG. 3
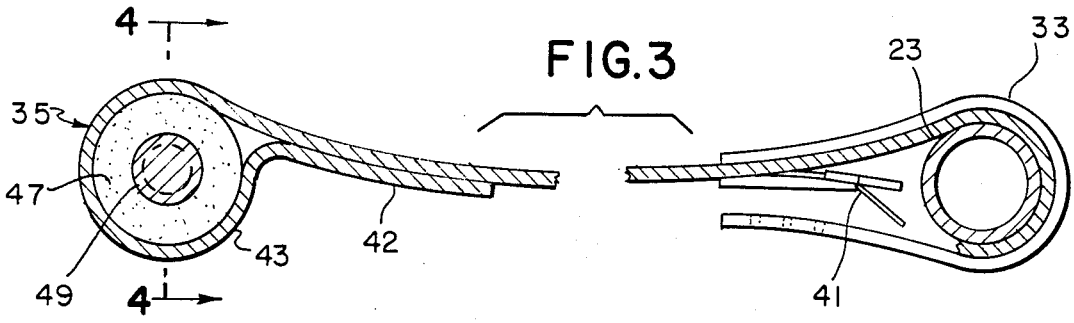

COMBINATION CARRYING POUCH AND SEAT FOR WALKERS

BACKGROUND OF THE INVENTION

The present invention relates to a combination carrying pouch and seat for walkers. In the prior art, it is known to provide a walker device with a tray or other article carrying member. Furthermore, removable seating areas for seats are also well known. However, applicant is not aware of any invention teaching a device designed to be incorporated in a walker device which may be used either as a seat or a carrying pouch. The following prior art is known to applicant.

U.S. Pat. No. 2,843,185 to Clem et al. discloses a convertible pack sack and camp stool frame. As seen in FIG. 3 thereof, the device may in one configuration be used as a seat with a removable fabric cover.

U.S. Pat. No. 4,184,618 to Jones discloses an article carrying attachment for walkers which comprises a tray device having hooks designed to facilitate attachment to a horizontal forward bar of the walker. No seating structure is contemplated by Jones.

U.S. Pat. No. 4,452,484 to Pastor discloses a walker device having the provision of a removable tray 42 as well as a removable seat 48. However, these elements are completely separate from one another and do not interact in any way.

U.S. Pat. No. 4,687,248 to Ross et al discloses a tote bag which may be converted into a lounge chair. However, this patent does not concern itself with walker devices and as such is believed to be of only general interest concerning the teachings of the present invention.

SUMMARY OF THE INVENTION

The present invention relates to a combination carrying pouch and seat for walkers. The present invention overcomes the deficiencies found in the prior art as discussed above and provides a device which may easily be detachably incorporated into an existing walker device so that the walker device may include either a carrying pouch or a seat. The present invention includes the following interrelated aspects and features:

(a) In a first aspect of the present invention, the inventive device is designed to be incorporated into an existing walker device of the type having four legs, handles, and a forward horizontal bar.

(b) The present invention includes a substantially rectangular piece of material formed of a panel, preferably made of a material such as heavy duty canvas of sufficient strength to support the weight of a human body. On one end of the panel, a pair of straps are securely fastened thereto and buckles are also securely fastened on an opposite face of the panel so that the straps may be securely fastened in a loop configuration.

(c) At another opposite end of the panel, the panel is folded upon itself and secured by suitable means such as, for example, sewing, to provide an elongated loop in which is inserted an elongated bar having its ends laterally exposed to the sides of the panel, which ends preferably include annular slots therein. Support hangers are provided, one for each slot which are connected to the bar due to the fact that the ends thereof are threadably connected to the rest of the bar and the hangers are retained on the bar when the ends are attached thereover.

(d) In operation, the above described straps are fastened to the forward horizontal bar of the walker by winding the straps about the horizontal bar and then fastening them to the buckles formed on the underside of the panel as described above. If the panel is to be used as a seat, the support hangers are attached to the elongated bar of the panel and are thereafter attached to opposed side bars of the walker at rear ends thereof. If it is desired to utilize the panel as a carrying pouch, the hangers are merely moved to forward ends of the opposed side bars so that the panel becomes configured in a loop-like configuration forming a storage chamber therein.

Accordingly, it is a first object of the present invention to provide an improved combination carrying pouch and seat for walkers.

It is a further object of the present invention to provide such a device which may be removably attachable to an existing walker structure.

It is a yet further object of the present invention to provide such a device which is designed not only to be able to support a person but which also may be used in a different configuration to store articles.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a perspective view of a walker device having the present invention incorporated therewith.

FIG. 2 shows a top view of the present invention.

FIG. 3 shows a cross-sectional view along the line 3—3 of FIG. 2, but with the forward end 33 of the inventive device 30 seen wrapped about the horizontal bar 23 as shown in FIG. 1.

FIG. 4 shows a cross-sectional view along the line IV—IV of FIG. 3.

FIG. 5 shows a front view of a support hanger designed for use in the present invention.

FIG. 6 shows a side view of the hanger shown in FIG. 5.

SPECIFIC DESCRIPTION OF THE PREFERRED EMBODIMENT

With reference first to FIG. 1, a typical walker device is generally designated by the reference numeral 1 and is seen to include legs 3, 5, 7 and 9, strengthening bars 11 and 13, opposed side bars 15 and 17 as well as handles 19 and 21, with the handle 19 being formed by a connection between the legs 7 and 9, and with the handle 21 being formed by a connection between the legs 3 and 5.

A forward horizontal bar 23 is attached forward of the legs 5 and 7 and upper portions thereof with a further horizontal bar 25 being attached forward of the opposed side bars 15 and 17.

Hand grips 27 and 29 are attached to respective handles 21 and 19. If desired, each leg may have a gripping member 28 attached to its bottom end.

With further reference to FIG. 1, it is seen that the inventive combination carrying pouch and seat is generally designated by the reference 30. With reference now to FIG. 2, the device 30 is seen to include a generally rectangular panel 31 having a forward end 33 and a rearward end 35.

The forward end 33 is seen to include a pair of opposed straps 37, 39 mounted on one face of the panel 31, and, with particular reference to FIG. 3, the opposed side of the panel 31 is seen to have fastened thereto buckles 41 of which one is shown in FIG. 3, which buckles 41 interact with the straps 37 and 39 to allow the forward end 33 of the panel 31 to be securely releasably fastened to the forward horizontal bar 23 of the walker 1 as seen in FIG. 1.

As further seen with reference to FIGS. 2 and 3, the rearward end 35 of the panel 31 is folded upon itself and fastened to itself to form an elongated loop-like configuration designated by the reference numeral 43, with the fastening being at the reference numeral 42 and being accomplished by any suitable means such as the stitching 45 seen in FIG. 2 or other suitable means, such as for example, adhesive.

Contained within the loop-like portion 43 of the panel 31 is an elongated piece 47 of padding, material which has a central region which carries an elongated solid bar 49 (as shown in FIG. 3) having ends 51 and 53 with blind bores (see FIG. 4). The end 51 is seen in FIG. 4 to define an annular recess 55 along with the adjacent structure of the bar 49 for a purpose to be described in greater detail hereinafter.

With reference back to FIG. 2, it is seen that at the forward end 33 of the panel 31, two side extensions 32 and 34 are formed each of which has one half of a hook and pile fastening means 36 formed on the sides facing upwardly in FIG. 1. Furthermore, at the rear end 35 of the panel 31 on underside surfaces thereof in the view of FIG. 2, the other halves 38 of the hook and pile fastening means are attached. These structures are provided for a purpose to be described in greater detail hereinafter.

With reference, now, to FIGS. 5 and 6, a hanger 60 is seen to include an elongated straight portion 61 having a bottom 63 with an opening 65 formed therein. The top 67 of the hanger 60 includes a curved portion 69 best seen in FIG. 6. The opening 65 is sized to allow the threaded stem 64 of end 51, 53 to pass therethrough and when the stem 64 is threaded into blind bore 66 of bar 49, the hanger 60 is thereby mounted thereto. The curved portion of each hanger 69 is made of a radius of curvature designed to allow easy interaction with the opposed side bars 15, 17 of the walker 1. As seen in FIG. 1, with the hangers 60 at the position shown in the full lines at the rearward end of the walker, the inventive device 30 comprises a seat. With the hangers 60 moved to a forward end of the walker as seen in phantom in FIG. 1, the panel 31 adopts a loop-like configuration providing a storage pouch. If desired, when the walker is being stored, the hangers 60 may be lifted away from the respective opposed side bars 15, 17 and may be allowed to hang freely as also seen in phantom in FIG. 1.

Furthermore, in the position shown in FIG. 1 wherein the panel adopts a loop-like configuration to thereby comprise a storage device, the hook and pile fastener halves 36 and 38 may be fastened together to securely maintain the panel 31 in the configuration shown in phantom in FIG. 1, to wit, a loop-like storage configuration. As should be understood, in the loop-like configuration, the extensions 32, 34 may be wrapped about the sides of the end 35 so that the respective hook and pile fastener halves 36, 38 may interengage to maintain the aforementioned loop-like configuration.

From the above description, the operation of the present invention should be self-evident. When it is desired to utilize the device 30 in conjunction with a walker 1, the forward end 33 of the panel 31 is fastened to the forward horizontal bar 23 of the walker by the straps 37,39 interacting with the buckles 41. Of course, other suitable fastening means may be utilized in this regard, including snap fasteners, hook and pile fastening means or other fastening means. It is important to note that whatever fastening means is used must be strong enough to facilitate the supporting of the entire weight of a human body when the device 30 is being used as a seat. Thus, straps and buckles have been chosen in the preferred embodiment since they are believed to be the strongest type of fastener of the type described above.

The hangers 60 are attached to the bar 49 as explained hereinabove, and the curved portions 69 of the hangers 60 are attached over the opposed side bars 15, 17 of the walker 1 either in the configuration shown in the full lines of FIG. 1 wherein it is desired to use the device 30 as a seat, or in the configuration shown in phantom in FIG. 1 wherein it is desired to use the device 30 as a carrying pouch. In the latter case, the hook and pile fastening halves 36, 38 are interconnected together by folding the portions 32 and 34 of the panel 31 over the sides of the end 35 to maintain the loop-like configuration shown in phantom in FIG. 1.

In the preferred embodiment, the bar 49 may be made of any strong material such as metal, P.V.C. rod or other strong material. The straps 37, 39 may be made of leather or other strong flexible material with the panel 31 being made of any strong material such as leather, cloth, canvas or the like. It is preferred that the hangers 60 be made of a metallic material since they must carry a great deal of weight when the device 30 is being used as a seat. Furthermore, the padding 47 may be made of any suitable resilient material such as that which is used to insulate water pipes.

As such, an invention has been disclosed in terms of a preferred embodiment thereof which fulfills each and every one of the objects of the invention as set forth hereinabove and provides a new and useful, versatile device for use with an existing walker device. Of course, various changes, modifications, and alterations in the teachings of the present invention may be contemplated by those skilled in the art without departing from the intended spirit and scope of the present invention. As such, it is intended that the present invention only be limited by the terms of the appended claims.

I claim:

1. In a walker device having a plurality of legs, a forward horizontal bar and two opposed side bars, the improvement comprising a combination carrying pouch and seat for said walker device, comprising:

(a) a panel having a forward end and a rearward end;

(b) first attachment means on said forward end for releasable attachment to said forward horizontal bar;

(c) second attachment means on said rearward end for releasable attachment to said opposed side bars at a plurality of spaced locations thereon, said spaced locations including a first location wherein said panel assumes a substantially open flat configuration allowing a person to sit thereon, and a second location wherein said panel assumes a substantially closed loop-like configuration allowing storage of items therein; and (d) maintaining means on said panel for releasably fastening said panel in said closed loop-like configuration.

2. The invention of claim 1, wherein said first attachment means comprises at least one strap and associated buckle allowing said releasable attachment of said forward end.

3. The invention of claim 1, wherein said second attachment means comprises a portion of said panel folded about itself and fastened to provide an elongated bar in said loop, said elongated bar having two ends protruding from said loop, and a hanger attached to each said end of said elongated bar, each said hanger being adapted to be releasably attached over a respective one of said opposed side bars in said plurality of spaced locations thereon.

4. The invention of claim 3 wherein each said end of said elongated bar includes an annular recess, and each said hanger includes an opening allowing said hanger to be attached at a respective annular slot of a respective end of said elongated bar.

5. The invention of claim 1, wherein said maintaining means comprises a pair of lateral extensions on said panel at one of said forward end and rearward end thereof, each said extension having one half of a fastening means mounted thereon, and the other half of said fastening means being mounted on the other of said forward end and rearward end of said panel, whereby when said second attachment means is located in said second location causing said panel to assume said substantially closed loop-like configuration, such fastening means halves may be engaged with one other to maintain said panel in said closed loop-like configuration.

6. The invention of claim 5, wherein said fastening means halves comprise respective halves of a hook and pile fastening means.

7. The invention of claim 1, wherein said panel is made of leather.

8. The invention of claim 1, wherein said second attachment means comprises an elongated metal bar.

* * * * *